US011311988B2

(12) United States Patent
Kuo

(10) Patent No.: US 11,311,988 B2
(45) Date of Patent: Apr. 26, 2022

(54) TORQUE CONNECTOR

(71) Applicant: Wen-Chin Kuo, Taichung (TW)

(72) Inventor: Wen-Chin Kuo, Taichung (TW)

( * ) Notice: Subject to any disclaimer, the term of this patent is extended or adjusted under 35 U.S.C. 154(b) by 433 days.

(21) Appl. No.: 16/452,586

(22) Filed: Jun. 26, 2019

(65) Prior Publication Data

US 2020/0055168 A1 Feb. 20, 2020

(30) Foreign Application Priority Data

Aug. 16, 2018 (TW) ..... 107128588

(51) Int. Cl.
*B25B 23/14* (2006.01)
*B25B 23/00* (2006.01)

(52) U.S. Cl.
CPC ..... *B25B 23/1405* (2013.01); *B25B 23/0007* (2013.01)

(58) Field of Classification Search
CPC . B25B 23/00; B25B 23/0007; B25B 23/0035; B25B 23/0042; B25B 23/14; B25B 23/1405; B25B 23/141; B25B 23/142; B25B 23/1422; B25B 23/1427; B25B 23/143
USPC ..... 173/47, 48, 109, 176
See application file for complete search history.

(56) References Cited

U.S. PATENT DOCUMENTS 2,854,831 A * 10/1958 Rothweiler ..... F16D 7/10 464/35
3,942,337 A 3/1976 Leonard et al.
5,063,797 A * 11/1991 Huang ..... B25B 13/463 81/60
5,678,961 A * 10/1997 Fleege ..... B23B 31/1071 279/144
6,832,533 B1 * 12/2004 Huang ..... B25B 23/1427 81/467
7,886,841 B2 * 2/2011 Armstrong ..... B25D 16/003 173/176
8,371,193 B2 * 2/2013 Huang ..... B25B 23/141 81/474
8,882,384 B2 * 11/2014 Bynum ..... B25B 23/1427 403/351
2009/0255386 A1 * 10/2009 Liao ..... B25B 23/141 81/474
2017/0312898 A1 * 11/2017 Hsieh ..... B25B 23/1427

FOREIGN PATENT DOCUMENTS

EP 0532289 A1 * 9/1992 ..... B25B 23/14

* cited by examiner

*Primary Examiner* — Andrew M Tecco
*Assistant Examiner* — Jacob A Smith
(74) *Attorney, Agent, or Firm* — Alan D. Kamrath; Karin L. Williams; Mayer & Williams PC

(57) ABSTRACT

A torque connector includes a first body provided with a pivot seat, at least one first receiving recess, and at least one second receiving recess, a second body provided with a pivot slot, a plurality of locking portions, and a plurality of projections, at least one drive member received in the at least one first receiving recess, and at least one elastic member received in the at least one second receiving recess and resting on the at least one drive member. When one of the locking portions aligns with the at least one first receiving recess, the at least one drive member is pushed by the at least one elastic member and locked in one of the locking portions, such that the second body drives and rotates the at least one drive member and the first body.

8 Claims, 12 Drawing Sheets

TORQUE CONNECTOR

BACKGROUND OF THE INVENTION

1. Field of the Invention

The present invention relates to a hand tool and, more particularly, to a torque connector or a torque limiting device.

2. Description of the Related Art

A conventional torque limiting device was disclosed in the U.S. Pat. No. 3,942,337, and comprises a first cup shaped section 1, a second cup shaped section 2, a first socket engaging stud 3, a second socket engaging stud 4, a positioning member, and a plurality of washers 10. The first socket engaging stud 3 has multiple recesses (or slots) 49. The second socket engaging stud 4 has multiple recesses (or slots) 47. The positioning member consists of a plurality of bearings 7. However, the bearings 7 are mounted in the recesses 49 of the first socket engaging stud 3 and the recesses 47 of the second socket engaging stud 4, such that the bearings 7 easily roll and fall down during the assembling process, thereby increasing the time and cost of assembly. In addition, each of the washers 10 has a lengthwise direction the same as that of the torque limiting device, such that the length of the torque limiting device is limited to and has to correspond to that of each of the washers 10. Further, each of the first socket engaging stud 3 and the second socket engaging stud 4 has a circular shape, the recesses 47 and 49 are arranged in a radiating shape, and each of the bearings 7 has a spherical shape, such that the bearings 7 and the recesses 47 and 49 only have a two-point contact, thereby decreasing the torque bearing effect. Further, the first socket engaging stud 3 and the second socket engaging stud 4 are spaced by the bearings 7, such that the diameter of each of the bearings 7 is limited.

BRIEF SUMMARY OF THE INVENTION

The primary objective of the present invention is to provide a torque connector that only includes three or four drive members at most, such that the torque connector is assembled easily.

In accordance with the present invention, there is provided a torque connector comprising a first body, a second body, at least one drive member, and at least one elastic member. The first body is provided with a first mounting portion, a pivot seat, at least one first receiving recess, and at least one second receiving recess. The second body is pivotally connected with the first body and provided with a second mounting portion and a pivot slot. The pivot slot includes a plurality of locking portions, and a plurality of projections. The at least one drive member is received in the at least one first receiving recess. The at least one elastic member is received in the at least one second receiving recess and rests on the at least one drive member. When one of the locking portions of the pivot slot aligns with the at least one first receiving recess, the at least one drive member is pushed by the at least one elastic member and locked in one of the locking portions, such that the second body drives and rotates the at least one drive member and the first body.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
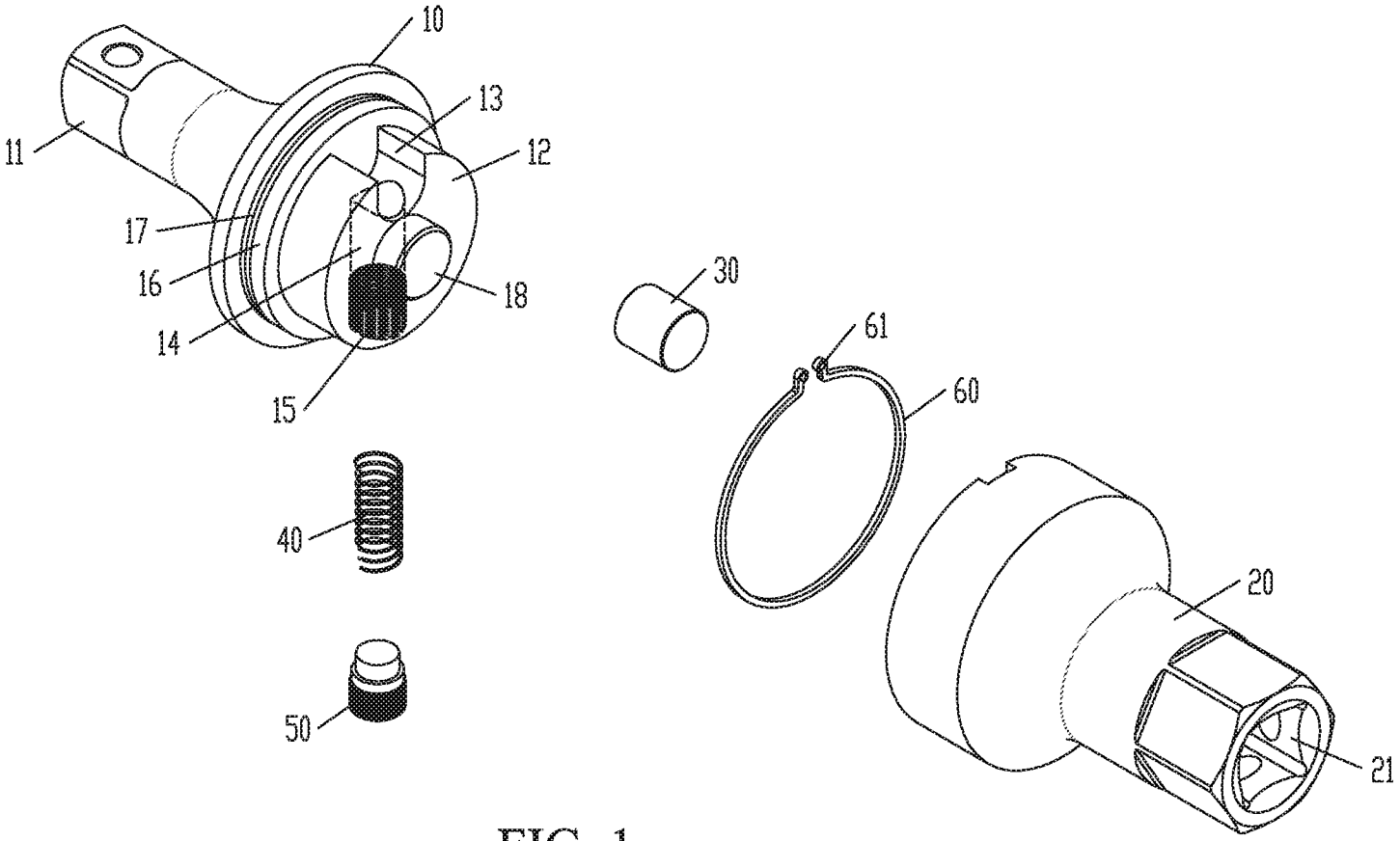
FIG. 1 is an exploded perspective view of a torque connector in accordance with the first embodiment of the present invention.
Figure 3:
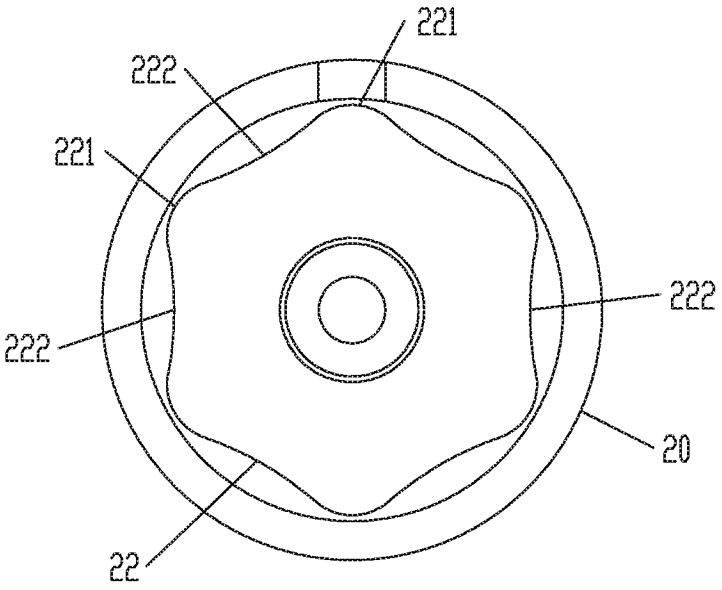
FIG. 3 is a front view of the second body as shown in FIG. 2.

Referring to the drawings and initially to FIGS. 1-9, a torque connector in accordance with the preferred embodiment of the present invention comprises a first body 10, a second body 20, at least one drive member 30, a first connecting member 50, at least one elastic member 40, and a snap ring 60.

The first body 10 has a first end provided with a first mounting portion 11 and a second end provided with a pivot seat 12. The pivot seat 12 has a circular shape and is provided with at least one first receiving recess 13 which has an arcuate shape. The pivot seat 12 is provided with at least one second receiving recess 14 which has a circular shape and is connected to the at least one first receiving recess 13. The at least one second receiving recess 14 has a lengthwise direction perpendicular to that of the first body 10, and has an axis perpendicular to that of the first body 10. The at least one second receiving recess 14 is provided with a first connecting portion 15 which is preferably an internal thread and is connected to the at least one second receiving recess 14. The at least one second receiving recess 14 is located between the at least one first receiving recess 13 and the first connecting portion 15. The first body 10 is provided with a first pivot portion 16 located between the first mounting portion 11 and the pivot seat 12. The first pivot portion 16 has a circular shape and has a diameter greater than that of the pivot seat 12. The first pivot portion 16 is provided with a first retaining groove 17 which has an annular shape. The pivot seat 12 is provided with a second pivot portion 18 which has a circular shape and has a diameter smaller than that of the pivot seat 12. The pivot seat 12 is located between the first pivot portion 16 and the second pivot portion 18.

The second body 20 is pivotally connected with the first body 10 and has a first end provided with a second mounting portion 21 and a second end provided with a pivot slot 22 pivotally mounted on the pivot seat 12. The pivot slot 22 includes a plurality of locking portions 221, and a plurality of projections 222 disposed between the locking portions 221. The pivot slot 22 is pivoted relative to the pivot seat 12, such that one of the locking portions 221 or one of the projections 222 aligns with the at least one first receiving recess 13. Each of the locking portions 221 has a concave face with a radius. Each of the projections 222 has a convex face with a radius. The concave face of each of the locking portions 221 is tangent to the convex face of each of the projections 222. The pivot slot 22 has a first end provided with a third pivot portion 23 which has a circular shape and is connected to the pivot slot 22. The third pivot portion 23 is pivotally mounted on the first pivot portion 16 and is provided with a second retaining groove 24 which has an annular shape and aligns with the first retaining groove 17. The second retaining groove 24 is provided with a cutout 25 which is connected to the second retaining groove 24. The pivot slot 22 has a second end provided with a fourth pivot portion 26 which has a circular shape and is connected to the pivot slot 22. The fourth pivot portion 26 is pivotally mounted on the second pivot portion 18. The pivot slot 22 is located between the third pivot portion 23 and the fourth pivot portion 26. The pivot slot 22 has a periphery provided with a through hole 27 which has a circular shape and is connected to the pivot slot 22. Thus, when the second body 20 is rotated until one of the locking portions 221 aligns with the at least one first receiving recess 13, the through hole 27 aligns with the first connecting portion 15. The pivot slot 22 is provided with an annular channel 28 which is connected to the pivot slot 22 and the through hole 27, and divides the pivot slot 22 into two parts.

The at least one drive member 30 is movably received in the at least one first receiving recess 13 and has a diameter matching the radius of one of the locking portions 221. The first connecting member 50 is connected with the first connecting portion 15. The first connecting member 50 is preferably an external thread. The at least one elastic member 40 is received in the at least one second receiving recess 14 of the first body 10 and biased between the at least one drive member 30 and the first connecting member 50, such that the first connecting member 50 stops and prevent the at least one elastic member 40 from being detached from the at least one second receiving recess 14. The at least one elastic member 40 has an axis perpendicular to that of the first body 10.

Thus, the first connecting member 50 is rotated to adjust a length of the at least one elastic member 40, and to adjust an elastic force of the at least one elastic member 40 applied on the at least one drive member 30, thereby adjusting the force of the at least one drive member 30 pressing one of the locking portions 221, and thereby adjusting the torque of the torque connector. After the torque of the torque connector is adjusted to a predetermined value, a tap is inserted into the through hole 27 to cover the first connecting member 50.

The at least one drive member 30 is pushed by the at least one elastic member 40 to partially protrude from the at least one first receiving recess 13 and partially protrude from a peripheral face of the pivot seat 12. Thus, when the second mounting portion 21 is driven, the second body 20 is rotated until one of the locking portions 221 of the pivot slot 22 aligns with the at least one first receiving recess 13, and the at least one drive member 30 is pushed by the at least one elastic member 40 and locked in one of the locking portions 221, such that the second body 20 drives and rotates the at least one drive member 30 and the first body 10.

The snap ring 60 is received in the first retaining groove 17 of the first body 10 and the second retaining groove 24 of the second body 20, such that the first body 10 and the second body 20 are assembled. The snap ring 60 is elastic and has two snap-fit portions 61 which are formed on two ends of the snap ring 60 and received in the cutout 25. Thus, when the two snap-fit portions 61 are pressed to approach each other, the snap ring 60 is contracted and detached from the second retaining groove 24 of the second body 20, such that the second body 20 is detached from the first body 10.

In the preferred embodiment of the present invention, the first mounting portion 11 is a square head (or stud), and the second mounting portion 21 is a square recess that is driven by a driving device, such as a ratchet wrench. The second mounting portion 21 has an exterior provided with a third mounting portion 211 which is a hexagonal head (or stud).

In the preferred embodiment of the present invention, the pivot slot 22 has a hexagonal shape and includes six locking portions 221, and six projections 222. Alternatively, the pivot slot 22 has a dodecagonal shape and includes twelve locking portions 221, and twelve projections 222.

In the preferred embodiment of the present invention, the at least one drive member 30 has a cylindrical shape. Alternatively, the at least one drive member 30 is a ball. Alternatively, the at least one drive member 30 has a bullet shape.

Figure 7:
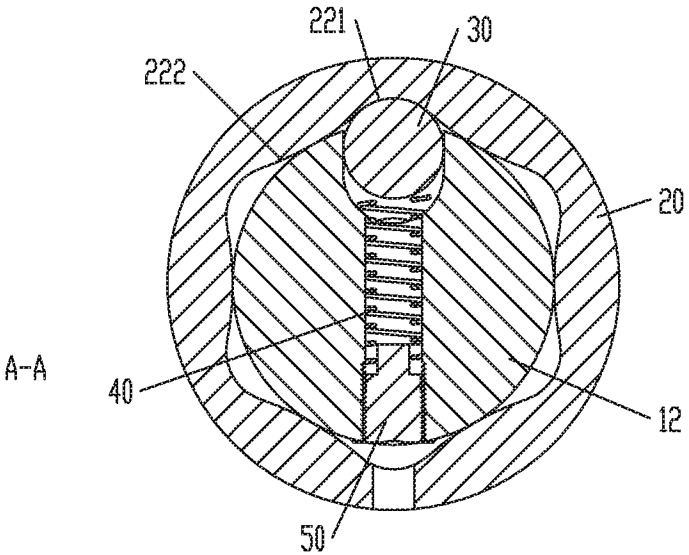
FIG. 7 is a cross-sectional view of the torque connector taken along line A-A as shown in FIG. 6.
Figure 8:
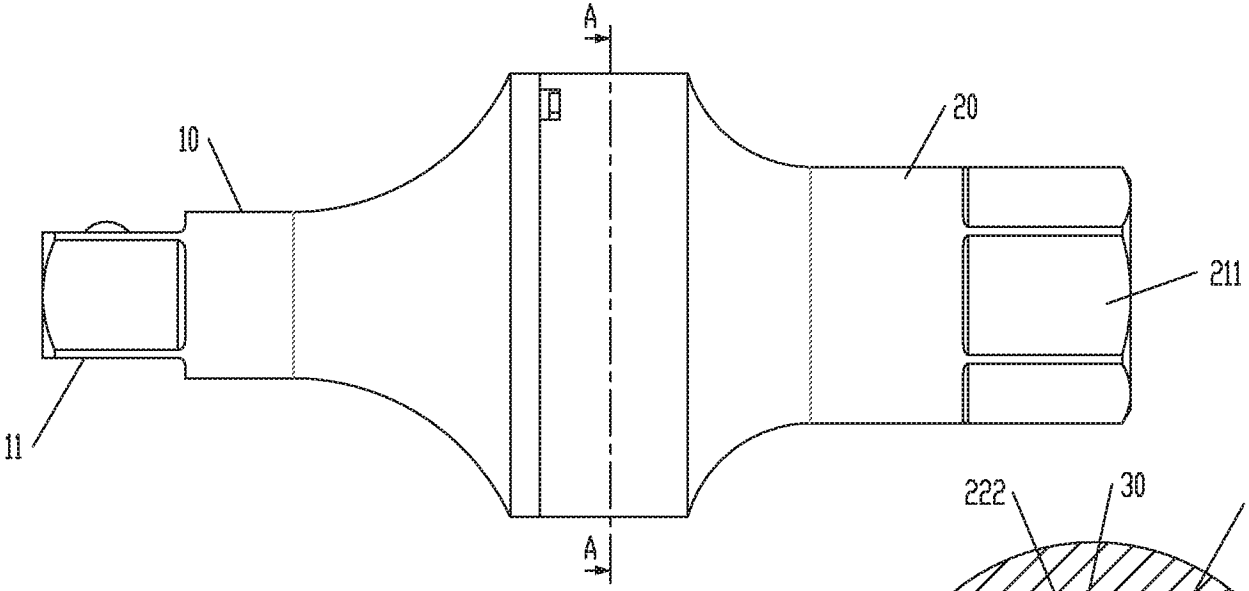
FIG. 8 is another front operational view of the torque connector as shown in FIG. 5.
Figure 9:
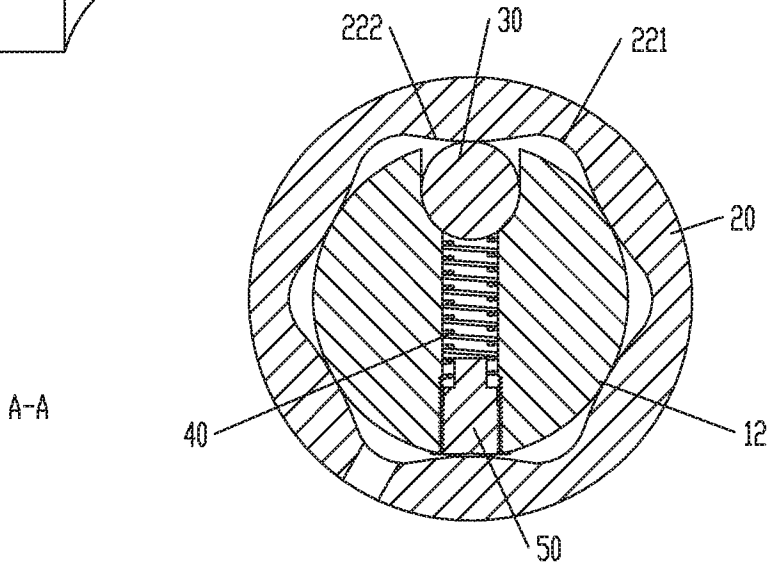
FIG. 9 is a cross-sectional view of the torque connector taken along line A-A as shown in FIG. 8.
Figure 10:
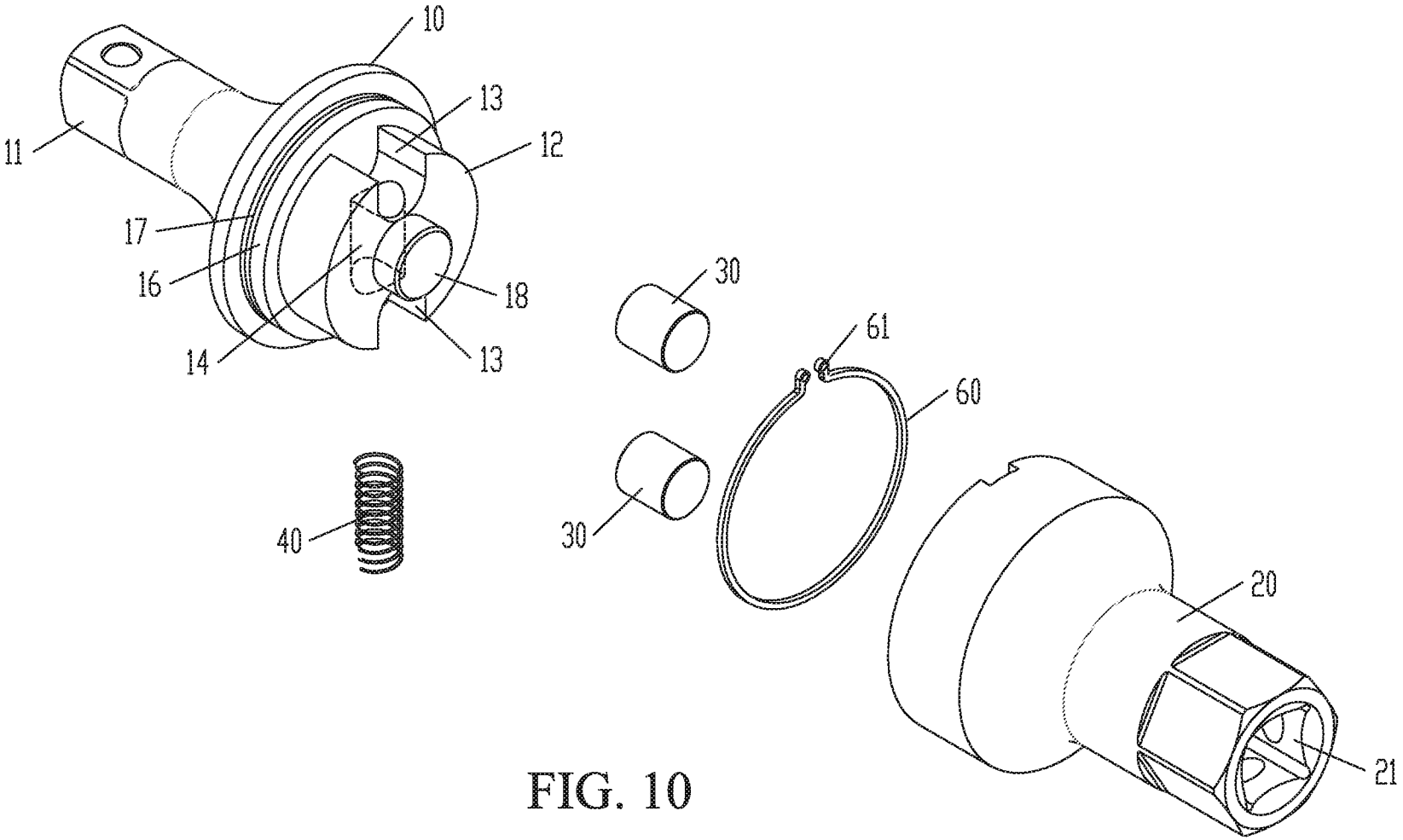
FIG. 10 is an exploded perspective view of a torque connector in accordance with the second embodiment of the present invention.
Figure 12:
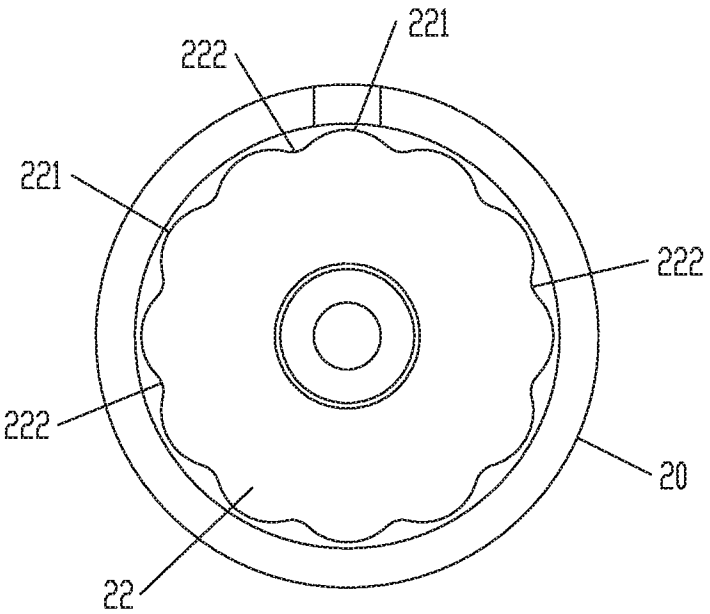
FIG. 12 is a front view of the second body as shown in FIG. 11.
Figure 11:
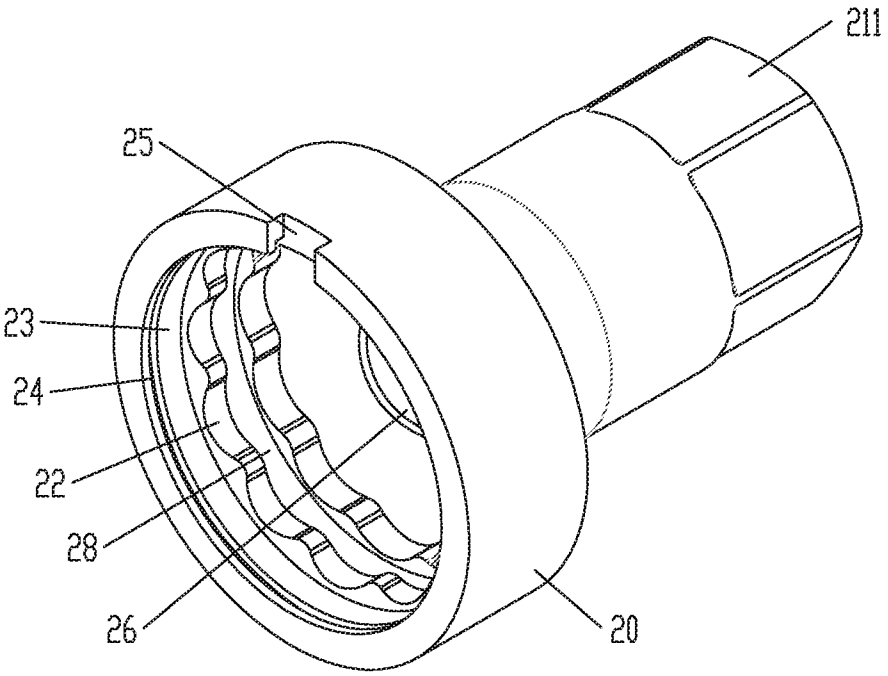
FIG. 11 is a perspective view of a second body of the torque connector as shown in FIG. 10.
Figure 13:
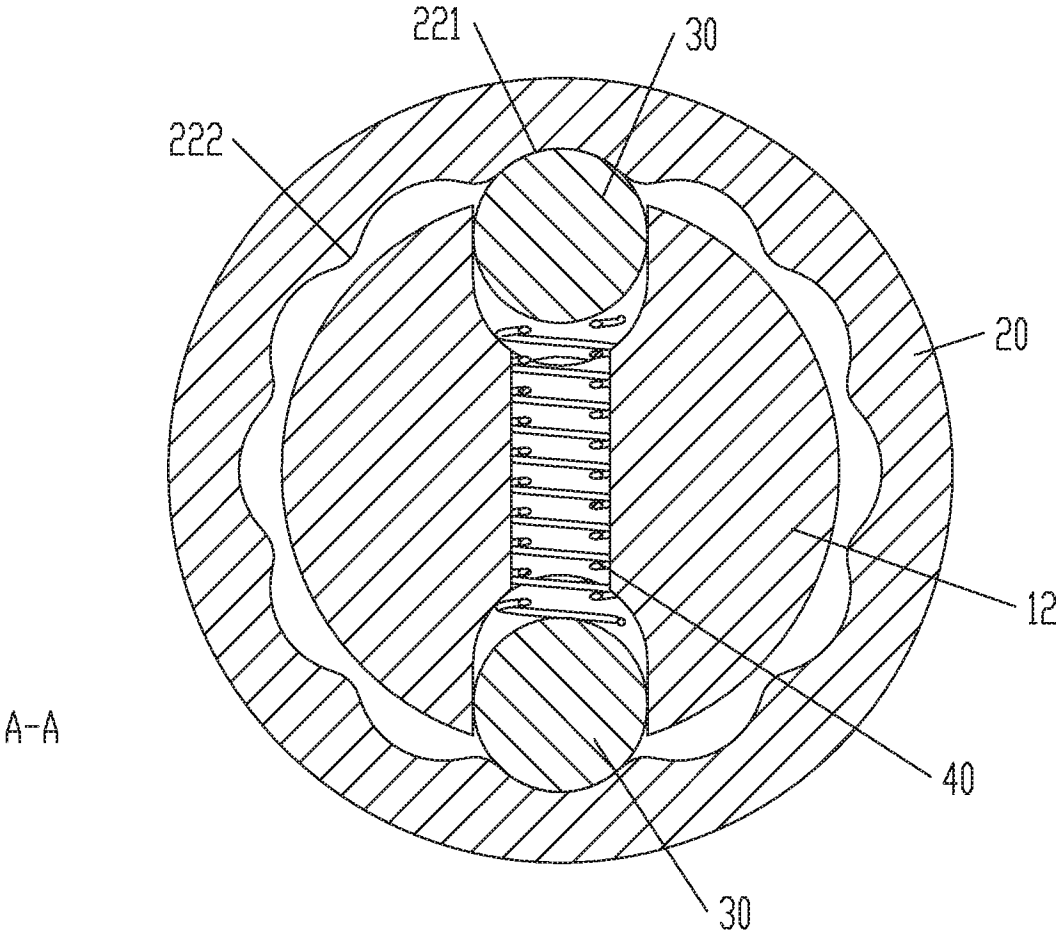
FIG. 13 is a cross-sectional assembly view of the torque connector as shown in FIG. 10.
Figure 14:
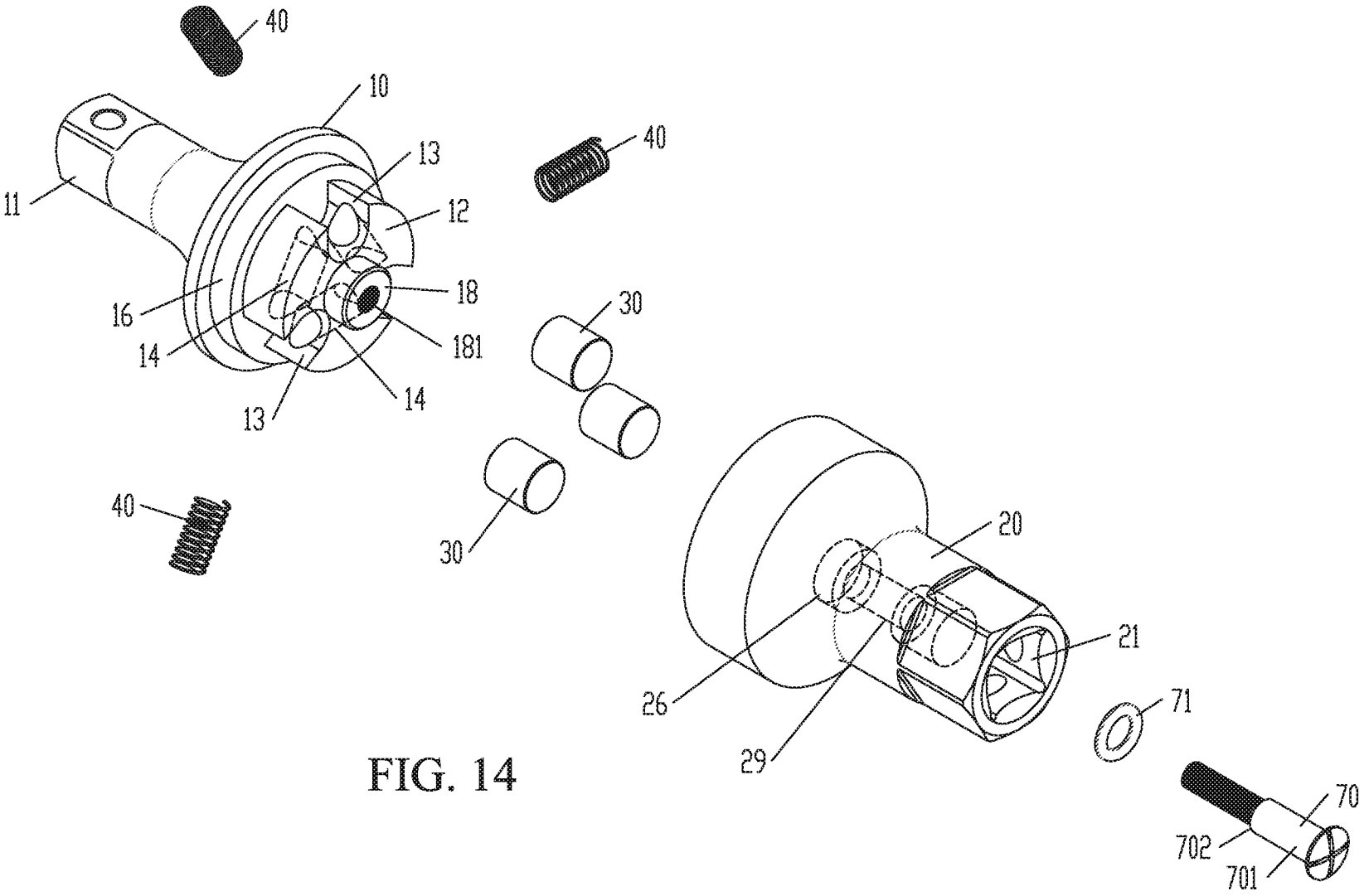
FIG. 14 is an exploded perspective view of a torque connector in accordance with the third embodiment of the present invention.
Figure 15:
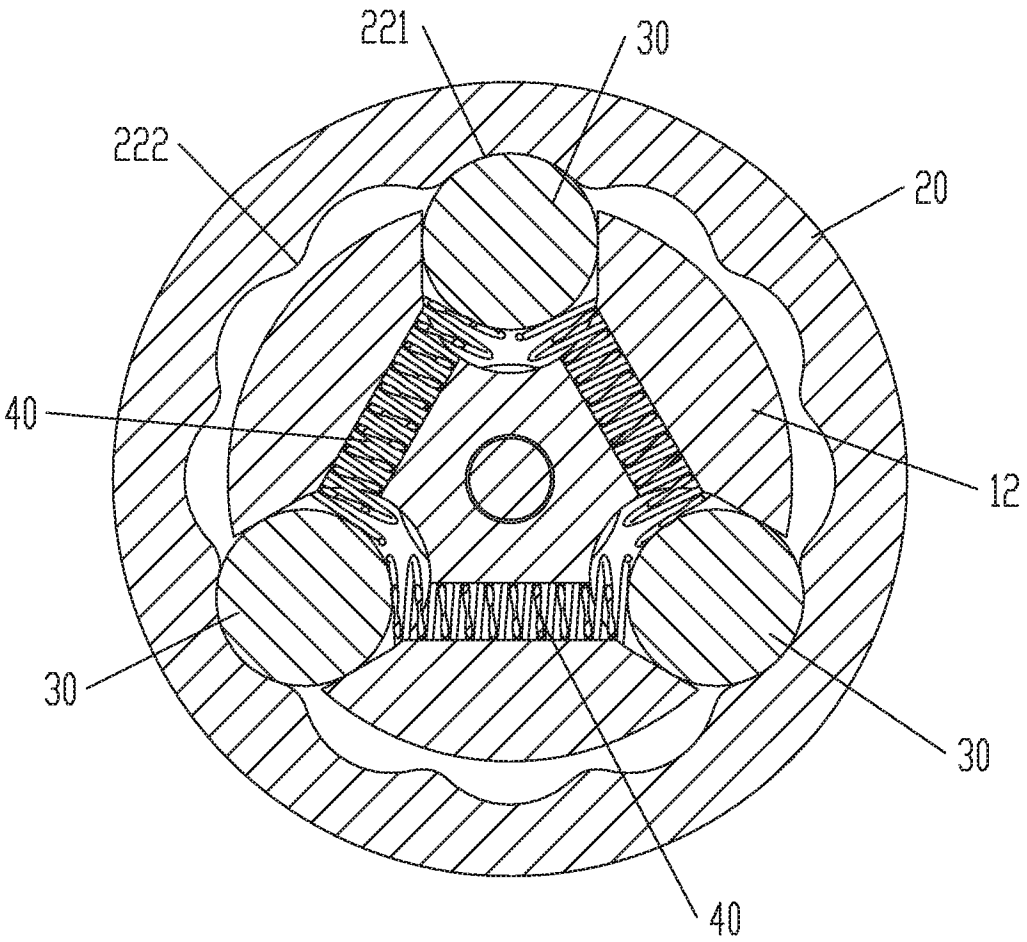
FIG. 15 is a cross-sectional assembly view of the torque connector as shown in FIG. 14.
Figure 17:
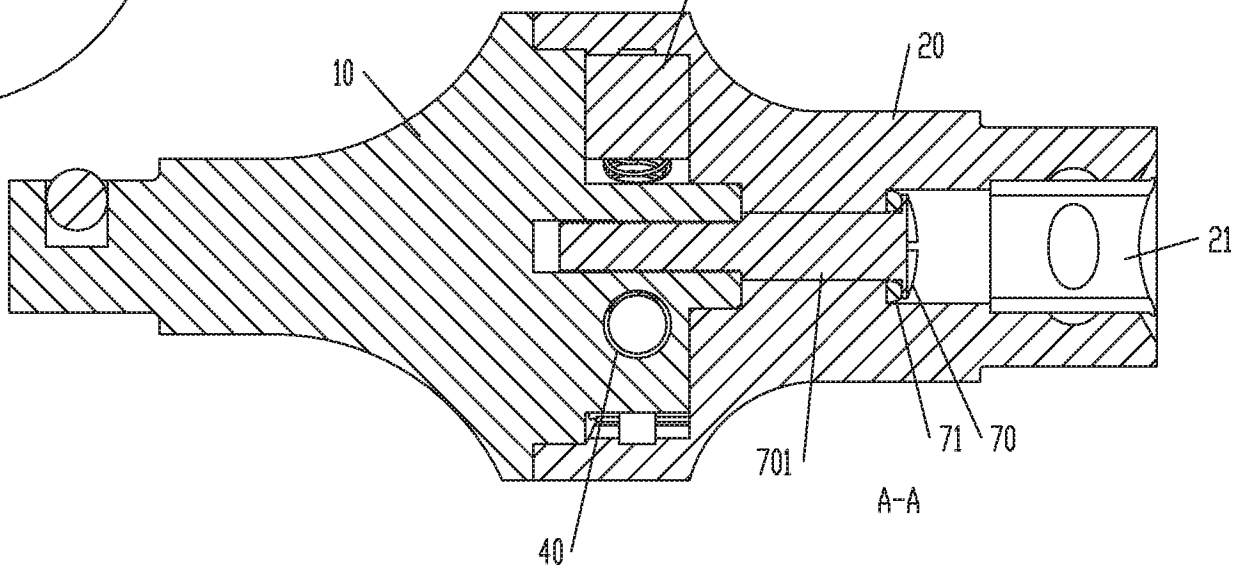
FIG. 17 is a cross-sectional view of the torque connector taken along line A-A as shown in FIG. 16.
Figure 16:
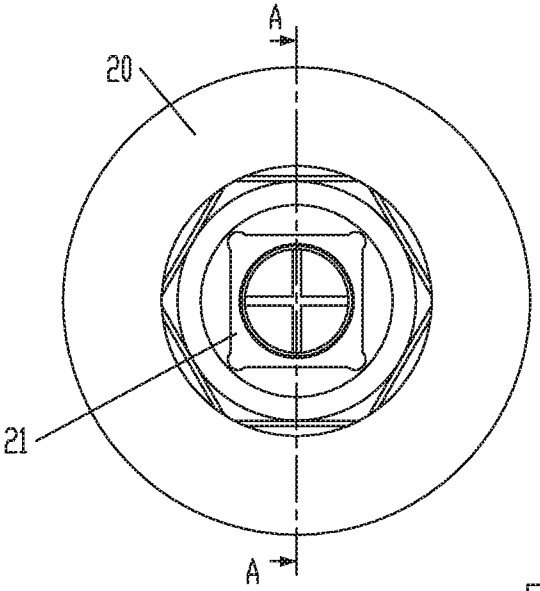
FIG. 16 is a front assembly view of the torque connector as shown in FIG. 14.

In operation, referring to FIGS. 6-9 with reference to FIGS. 1-5, the first mounting portion 11 is connected with a socket which is connected with a screw member which is screwed into a screw hole. At this time, the at least one drive member 30 is locked in one of the locking portions 221 as shown in FIG. 7, such that when the second body 20 is rotated, the at least one drive member 30 is driven to rotate the first body 10. In such a manner, the first body 10 is driven by the second body 20 to rotate the socket which rotates the screw member which is screwed through the screw hole successively. When the screw member is entirely screwed into the screw hole and stops rotating, the first body 10 is not rotated any more, but the second body 20 is rotated continuously, such that the force of the second body 20 applied on the at least one drive member 30 is greater than the elastic force of the at least one elastic member 40, and the at least one drive member 30 is pressed by the pivot slot 22 of the second body 20 and detached from one of the locking portions 221 of the pivot slot 22. When the second body 20 is rotated until one of the projections 222 aligns with the at least one first receiving recess 13 and the at least one drive member 30 as shown in FIG. 9, the at least one drive member 30 is pressed by one of the projections 222 and retracted into the at least one first receiving recess 13, such that the second body 20 cannot drive the at least one drive member 30 and the first body 10. Thus, when the force applied on the first body 10 exceeds a limit, the second body 20 performs an idle rotation, to prevent the screw member from being subjected to an excessive torque, and to prevent the screw member from being worn out or broken.

In another preferred embodiment of the present invention, the first mounting portion 11 is a polygonal recess to directly drive the screw member, such that the torque connector functions as a torque socket wrench. The second mounting portion 21 is a transverse rod to provide a torque for rotating the second body 20.

In another preferred embodiment of the present invention, the at least one second receiving recess 14 has a first end connected to the at least one first receiving recess 13 and a second end that is closed, and the at least one elastic member 40 is biased between the at least one drive member 30 and the closed second end of the at least one second receiving recess 14. Thus, the first connecting portion 15 is undefined.

Figure 2:
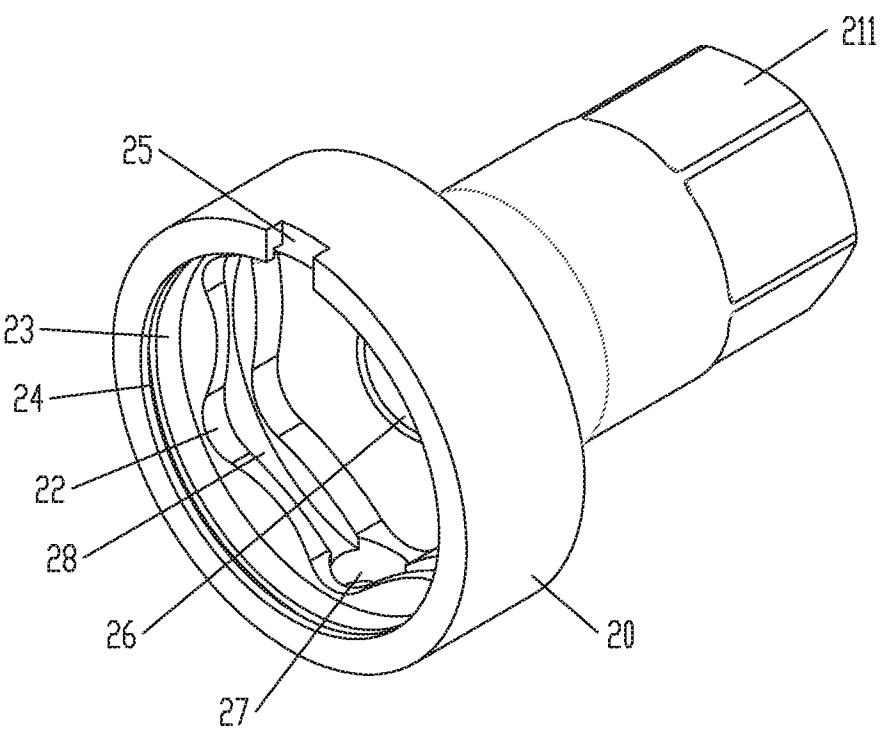
FIG. 2 is a perspective view of a second body of the torque connector as shown in FIG. 1.
Figure 4:
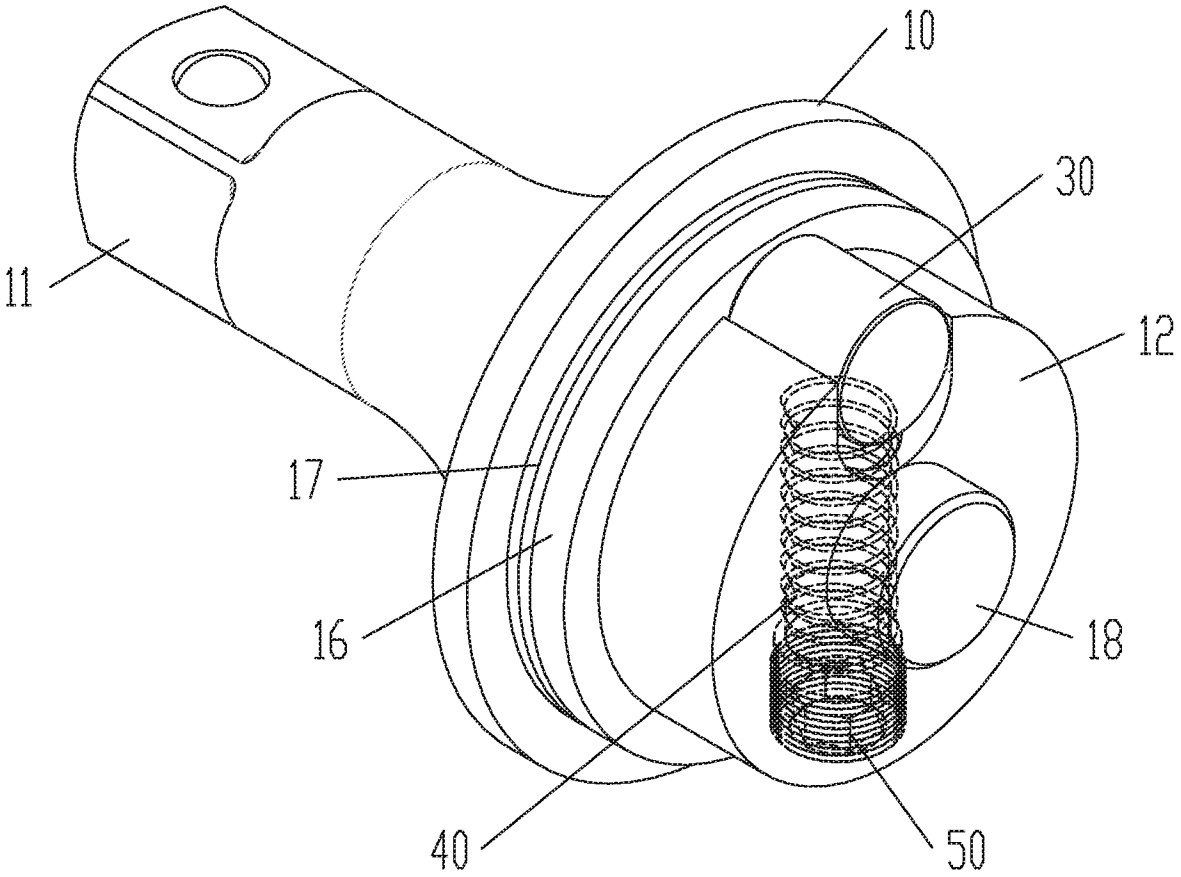
FIG. 4 is a partial perspective assembly view of the torque connector as shown in FIG. 1.
Figure 5:
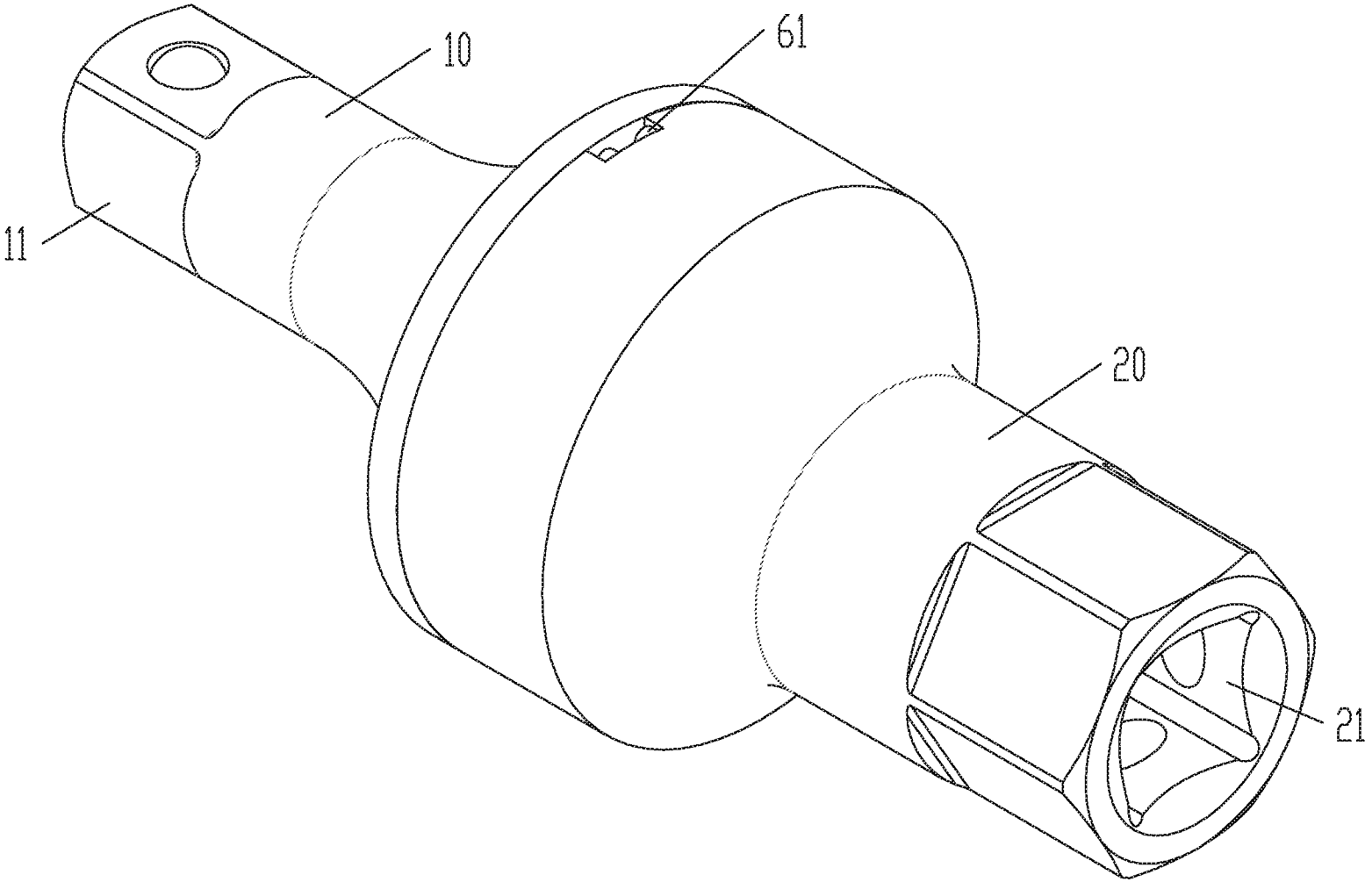
FIG. 5 is a perspective assembly view of the torque connector as shown in FIG. 1.
Figure 6:
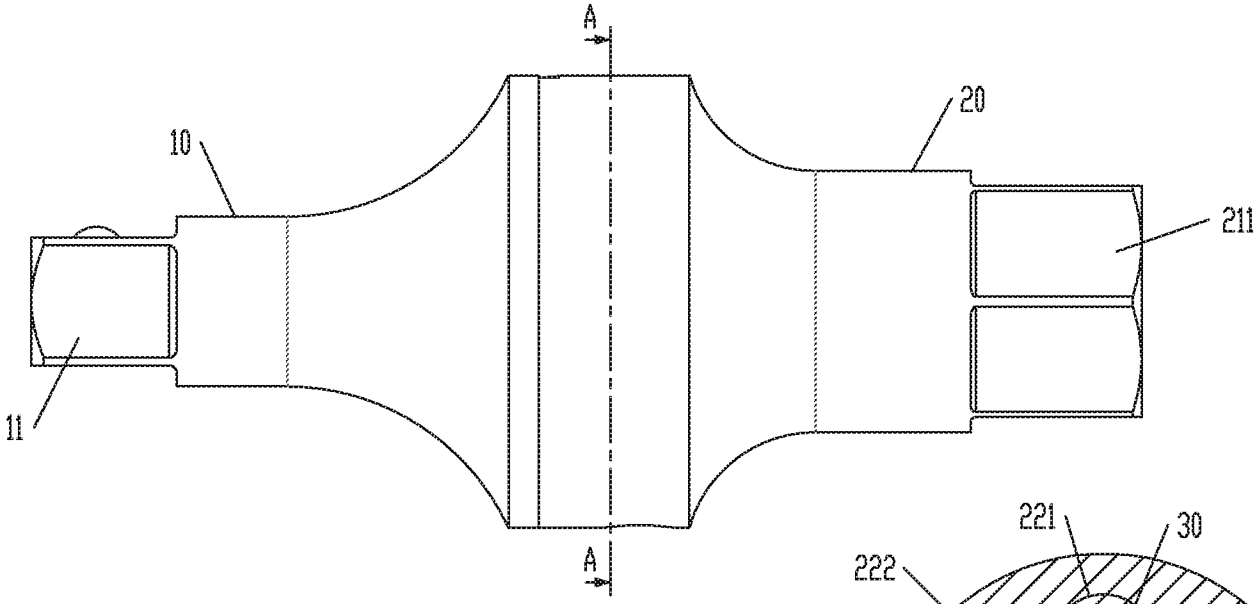
FIG. 6 is a front view of the torque connector as shown in FIG. 5.

Referring to FIGS. 10-13, the pivot seat 12 is provided with two first receiving recesses 13 spaced from and aligning with each other, the at least one second receiving recess 14 is arranged between the two first receiving recesses 13, the torque connector comprises two drive members 30 received in the two first receiving recesses 13 respectively, and the at least one elastic member 40 is biased between the two drive members 30. Thus, the first connecting portion 15 as shown in FIG. 1, and the through hole 27 as shown in FIG. 2 are undefined. In addition, the pivot slot 22 has a dodecagonal shape and includes twelve locking portions 221, and twelve projections 222.

Referring to FIGS. 14-17, the pivot seat 12 is provided with three first receiving recesses 13 which are arranged annularly relative to the axis of the first body 10. The pivot seat 12 is provided with three second receiving recesses 14 arranged between and connected to the three first receiving recesses 13. The three second receiving recesses 14 present a triangular shape. The first body 10 is provided with a second connecting portion 181 which extends through the second pivot portion 18, the pivot seat 12 and the first pivot portion 16. The second connecting portion 181 is preferably an internal thread. The second body 20 is provided with a third connecting portion 29 arranged between and connected to the second mounting portion 21 and the pivot slot 22. The torque connector comprises three drive members 30 received in the three first receiving recesses 13 respectively, and three elastic members 40 received in the three second receiving recesses 14. Each of the three elastic members 40 is biased between any two of the three drive members 30. The torque connector further comprises a second connecting member 70 extending through the third connecting portion 29 and connected with the second connecting portion 181, such that the second body 20 and the first body 10 are assembled. The second connecting member 70 has an external thread. Thus, the first connecting portion 15 and the first retaining groove 17 as shown in FIG. 1 are undefined. In addition, the second retaining groove 24, the cutout 25 and the through hole 27 as shown in FIG. 2 are undefined.

The second connecting member 70 has a shank 701 and a resting face 702. The shank 701 is received in the third connecting portion 29. The resting face 702 rests on an end face of the first body 10. The torque connector further comprises a washer 71 mounted on the second connecting member 70 and located between the second connecting member 70 and the second body 20. The shank 701 has a length slightly greater than a total length of that of the third connecting portion 29 and that of the washer 71, such that the second body 20 and the first body 10 are assembled exactly. The washer 71 has a convex face directed toward the second connecting member 70, to reduce a friction between the washer 71 and the second connecting member 70.

Accordingly, the operator only needs to press the at least one drive member 30 and compress the at least one elastic member 40 for mounting the second body 20 onto the first body 10, such that the second body 20 and the first body 10 are assembled easily. In addition, each of the locking portions 221 has a concave face with a radius, such that the at least one drive member 30 is received in one of the locking portions 221 exactly. Further, the at least one drive member 30 has a cylindrical shape so that the at least one drive member 30 and each of the locking portions 221 have a larger contact area, to withstand a greater torque. Further, the at least one drive member 30 has the shape of a cylinder, a ball or a bullet, to provide a diversity of utilization. Further, the at least one elastic member 40 is received in the at least one second receiving recess 14 of the first body 10 and has an axis perpendicular to that of the first body 10, such that the torque connector is not restricted by the at least one elastic member 40 and may have a shorter length. Further, the length of the at least one drive member 30 does not interfere with the clearance between the first body 10 and the second body 20, to preventing from reducing the torque of the torque connector. Further, when the second body 20 is rotated until one of the locking portions 221 of the pivot slot 22 aligns with the at least one first receiving recess 13, the at least one drive member 30 is pushed by the at least one elastic member 40 and locked in one of the locking portions 221, such that the second body 20 drives and rotates the at least one drive member 30 and the first body 10. Further, when the force applied on the first body 10 by the second body 20 exceeds a limit, the at least one drive member 30 is detached from one of the locking portions 221 and retracted into the at least one first receiving recess 13, such that the second body 20 cannot drive the at least one drive member 30 and the first body 10, and performs an idle rotation. Further, he third pivot portion 23 is pivotally mounted on the first pivot portion 16, and the fourth pivot portion 26 is pivotally mounted on the second pivot portion 18, such that the pivot slot 22 is mounted on the pivot seat 12 exactly. Further, the pivot slot 22 is provided with an annular channel 28 to enhance the structural toughness (or strength) of the pivot slot 22, when the pivot slot 22 is subjected to a force.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A torque connector comprising:

a first body, a second body, at least one drive member, a first connecting member, at least one elastic member, and a snap ring;

wherein:

the first body has a first end provided with a first mounting portion and a second end provided with a pivot seat;

the pivot seat has a circular shape and is provided with at least one first receiving recess;

the pivot seat is provided with at least one second receiving recess which is connected to the at least one first receiving recess;

the at least one second receiving recess has an axis perpendicular to that of the first body;

the at least one second receiving recess is provided with a first connecting portion which is connected to the at least one second receiving recess;

the at least one second receiving recess is located between the at least one first receiving recess and the first connecting portion;

the first body is provided with a first pivot portion located between the first mounting portion and the pivot seat;

the first pivot portion has a circular shape and has a diameter greater than that of the pivot seat;

the first pivot portion is provided with a first retaining groove;

the pivot seat is provided with a second pivot portion which has a circular shape and has a diameter smaller than that of the pivot seat;

the pivot seat is located between the first pivot portion and the second pivot portion;

the second body is pivotally connected with the first body and has a first end provided with a second mounting portion and a second end provided with a pivot slot pivotally mounted on the pivot seat;

the pivot slot includes a plurality of locking portions, and a plurality of projections disposed between the locking portions;

the pivot slot is pivoted relative to the pivot seat, such that one of the locking portions or one of the projections aligns with the at least one first receiving recess;

each of the locking portions has a concave face with a radius;

each of the projections has a convex face with a radius;

the concave face of each of the locking portions is tangent to the convex face of each of the projections;

the pivot slot has a first end provided with a third pivot portion which has a circular shape and is connected to the pivot slot;

the third pivot portion is pivotally mounted on the first pivot portion and is provided with a second retaining groove which aligns with the first retaining groove;

the second retaining groove is provided with a cutout which is connected to the second retaining groove;

the pivot slot has a second end provided with a fourth pivot portion which has a circular shape and is connected to the pivot slot;

the fourth pivot portion is pivotally mounted on the second pivot portion;

the pivot slot is located between the third pivot portion and the fourth pivot portion;

the pivot slot has a periphery provided with a through hole which is connected to the pivot slot;

when the second body is rotated until one of the locking portions aligns with the at least one first receiving recess, the through hole aligns with the first connecting portion;

the pivot slot is provided with an annular channel which is connected to the pivot slot and the through hole, and divides the pivot slot into two parts;

the at least one drive member is movably received in the at least one first receiving recess and has a diameter matching the radius of one of the locking portions;

the first connecting member is connected with the first connecting portion;

the at least one elastic member is received in the at least one second receiving recess of the first body and biased between the at least one drive member and the first connecting member;

the at least one elastic member has an axis perpendicular to that of the first body;

the at least one drive member is pushed by the at least one elastic member to partially protrude from the at least one first receiving recess and partially protrude from a peripheral face of the pivot seat;

when one of the locking portions of the pivot slot aligns with the at least one first receiving recess, the at least one drive member is pushed by the at least one elastic member and locked in one of the locking portions, such that the second body drives and rotates the at least one drive member and the first body;

the snap ring is received in the first retaining groove of the first body and the second retaining groove of the second body, such that the first body and the second body are assembled; and the snap ring is elastic and has two snap-fit portions which are formed on two ends of the snap ring and received in the cutout.

2. The torque connector of claim 1, wherein the second mounting portion has an exterior provided with a third mounting portion which is a hexagonal head.

3. The torque connector of claim 1, wherein the pivot slot has a hexagonal shape and includes six locking portions, and six projections, or the pivot slot has a dodecagonal shape and includes twelve locking portions, and twelve projections.

4. The torque connector of claim 1, wherein the at least one drive member has a cylindrical shape, is a ball or has a bullet shape.

5. The torque connector of claim 1, wherein the pivot seat is provided with two first receiving recesses spaced from and aligning with each other, the at least one second receiving recess is arranged between the two first receiving recesses, the torque connector comprises two drive members received in the two first receiving recesses respectively, and the at least one elastic member is biased between the two drive members.

6. The torque connector of claim 1, wherein:

the pivot seat is provided with three first receiving recesses which are arranged annularly relative to the axis of the first body;

the pivot seat is provided with three second receiving recesses arranged between and connected to the three first receiving recesses;

the three second receiving recesses present a triangular shape;

the first body is provided with a second connecting portion which extends through the second pivot portion, the pivot seat and the first pivot portion;

the second body is provided with a third connecting portion arranged between and connected to the second mounting portion and the pivot slot;

the torque connector comprises three drive members received in the three first receiving recesses respectively, and three elastic members received in the three second receiving recesses;

each of the three elastic members is biased between any two of the three drive members; and the torque connector further comprises a second connecting member extending through the third connecting portion and connected with the second connecting portion.

7. The torque connector of claim 6, wherein:

the second connecting member has a shank and a resting face;

the shank is received in the third connecting portion;

the resting face rests on an end face of the first body;

the torque connector further comprises a washer mounted on the second connecting member and located between the second connecting member and the second body;

the shank has a length slightly greater than a total length of that of the third connecting portion and that of the washer; and the washer has a convex face directed toward the second connecting member.

8. The torque connector of claim 1, wherein the at least one second receiving recess has a first end connected to the at least one first receiving recess and a second end that is closed, and the at least one elastic member is biased between the at least one drive member and the closed second end of the at least one second receiving recess.

* * * * *